United States Patent [19]

Starr

[11] 4,051,944

[45] Oct. 4, 1977

[54] CAPSTAN DRIVEN, ENDLESS PRINTER RIBBON CARTRIDGE

[75] Inventor: David G. Starr, Renton, Wash.

[73] Assignee: Tally Corporation, Kent, Wash.

[21] Appl. No.: 687,171

[22] Filed: May 17, 1976

[51] Int. Cl.[2] ..... B41J 33/10

[52] U.S. Cl. ..... 197/168; 197/151

[58] Field of Search ..... 101/336; 197/151, 168; 242/55.19 A

[56] References Cited

U.S. PATENT DOCUMENTS

| | | | |
|---|---|---|---|
| 3,311,316 | 3/1967 | Williams | 242/55.19 A |
| 3,524,602 | 8/1970 | Greene | 242/55.53 X |
| 3,621,968 | 11/1971 | Kondur | 197/151 |
| 3,728,963 | 4/1973 | Dowd | 197/168 X |

*Primary Examiner*—Edgar S. Burr
*Assistant Examiner*—Paul T. Sewell
*Attorney, Agent, or Firm*—Christensen, O'Connor, Garrison & Havelka

[57] ABSTRACT

A capstan driven, endless printer ribbon cartridge comprising an endless ribbon and a flat housing formed of a planar base and an enclosing planar top with downwardly projecting edge walls is disclosed. The housing includes an appendage within which a guide roller, or an inking roller, is located. Ribbon enters the housing via an edge wall slot located adjacent the guide or inking roller and runs around the roller to a relatively large aperture at which a pair of pinch rollers are located. The pinch rollers, when the cartridge is mounted in a suitable printer, press the ribbon against a capstan. The ribbon runs from the pinch rollers to the outer periphery of a rotatable ribbon roll located about a non-rotatable hub integrally formed with the base. The ribbon leaves the ribbon roll via an angle slot formed in the non-rotatable hub. A ribbon leaf spring having a semicircular hook-shaped end extends outwardly from the hub against the inner loop of the ribbon roll to provide tape withdrawal friction (output tension) and to assist in aligning the tape with the angle slot. The endless ribbon has the configuration of a Mobius strip.

10 Claims, 10 Drawing Figures

CAPSTAN DRIVEN, ENDLESS PRINTER RIBBON CARTRIDGE

BACKGROUND OF THE INVENTION

This invention is directed to ribbon cartridges and, more particularly, to ribbon cartridges suitable for use in printers, particularly line printers.

various types of ribbon cartridges suitable for use in printers and the like have been proposed by the prior art. The ribbon cartridges generally fall into two groups, endless and non-endless. The non-endless cartridges generally include a takeup reel and a supply reel and the ribbon moves from the supply reel to the takeup reel, as required, during printer operation. In some instances the ribbon is reusable and the supply and takeup reels switch functions when all or substantially all of the ribbon has moved from the supply reel to the takeup reel. In some cases the printer operator is required to invert the ribbon cartridge to extend its life.

The other types of ribbon cartridges, which are of more significance to the present invention, are endless cartridges. In endless cartridges an endless ribbon is moved from one aperture in a cartridge housing, through the printer mechanism, and back to the cartridge housing. In some cartridges the ribbon is merely "stuffed" into the cartridge housing. In other cartridges, the ribbon is drawn into a ribbon roll. As ribbon is removed from one end of the roll and fed into the printer, ribbon is continuously added to the other end of the roll, with individual roll loops sliding with respect to one another.

Endless ribbon cartridges proposed by the prior art vary from relatively complicated to relatively unsophisticated cartridges. Examples of relatively complicated printer ribbon cartridges, at least with respect to their internal structure, using a "stuffed" technique are described in U.S. Pat. Nos. 3,814,231 and 3,830,351, both issued to Samuel D. Cappotto, the first for a "stuffed Ribbon Cartridge" and the second for a "Typewriter Ribbon Cartridge For Endless Loop Ribbon." Examples of somewhat similar cartridges using a ribbon roll technique are described in U.S. Pat. Nos. 3,643,777 issued to Carl P. Anderson et al. for "Typewriter Ribbon Cartridge" and 3,643,779 issued to Carl P. Anderson, et al. for "Ribbon Mechanism for Cartridge Supported Ribbons." In addition to their somewhat complicated internal mechanisms, the cartridges described in these patents have the further disadvantage that they are designed such that ribbon enters and leaves the cartridge housing from generally the same slot whereby the housing must be greater than twice the width of the tape in height or thickness.

A somewhat less complicated endless ribbon cartridge structure is described in U.S. Pat. No. 3,524,602 issued to Pierre J. Green et al. for "Endless Ribbon Cartridge." While this patent describes an arrangement somewhat similar in its broad aspects to the present invention, as will be better understood from the following description, it lacks certain features thereof. For example, it does not provide for a capstan drive mechanism to "pull" ribbon into a cartridge housing. Further, it does not provide for inking of the ribbon internally in the housing. Moreover, while it includes a tensioning spring, the spring does not act to align the ribbon with an exit aperture whereby ease of accurate withdrawal of the ribbon, without ribbon breakage, is not provided.

As will also be better understood from the following description, one of the features of the invention is that the ribbon is in the form of a Mobius strip. While this general ribbon form has been proposed before by the prior art (see U.S. Pat. No. 3,460,666 issued to W. Ploeger, Jr. for "Endless Printing Ribbon"), the prior art has not proposed the use of a Mobius strip ribbon in an endless loop cartridge wherein a majority of the ribbon length forms a roll housed in a cartridge housing. Without this feature only a limited amount of ribbon is available for use.

Therefore, it is an object of this invention to provide a new and improved endless, printer ribbon cartridge.

It is a further object of this invention to provide a capstan driven endless printer ribbon cartridge.

It is another object of this invention to provide an endless loop capstan driven printer ribbon cartridge.

It is yet another object of this invention to provide a Mobius strip, endless loop, capstan driven, printer ribbon cartridge wherein a majority of the printer ribbon forms a roll housed within a cartridge housing, even when the capstan driven printer ribbon cartridge is mounted for use in a suitable printer.

SUMMARY OF THE INVENTION

In accordance with principles of this invention, a capstan driven, endless printer ribbon cartridge is provided. The cartridge comprises a flat housing including a planar base and an enclosing planar top with edge walls projecting toward the base. The housing is formed so as to include an integral appendage within which a guide roller, or an inking roller, is located. An endless, Mobius strip, ribbon enters the housing via an edge wall slot located adjacent the guide or inking roller, passes over the roller and runs to a relatively large aperture. Located at the large aperture are a pair of pinch rollers that, when the cartridge is mounted in a suitable printer, press the ribbon against a capstan. The ribbon is thus pulled into the cartridge by the capstan. The ribbon leaving the pinch rollers runs to the outer periphery of a rotatable ribbon roll located about a non-rotatable hub integrally formed with either the base or top. The ribbon leaves the ribbon roll via an angle slot formed in the non-rotatable hub. As the ribbon is withdrawn, the rotatable ribbon roll rotates and adds, to tis outer periphery, ribbon leaving the pinch rollers. Intermediate loops of the rotatable ribbon roll slip with respect to one another as the roll is rotated.

In accordance with other principles of this invention a ribbon leaf spring having a semicircular hook-shaped end extends outwardly from the hub and presses against the inner loop of the ribbon roll. The ribbon leaf spring has two functions. First, the ribbon leaf spring provides ribbon withdrawal friction (output ribbon tension) and prevents interloop seizing. Second, the ribbon leaf spring is positioned so as to align the ribbon with the angle slot. That is, the ribbon leaving the spring heads directly toward and, then, through the angle slot, as opposed to following the curvature of the hub prior to leaving via the angle slot.

In accordance with still other principles of this invention, the pinch roller immediately before the ribbon roll is flexure mounted to provide constant guide or inking roll tension.

It will be appreciated from the foregoing description that the invention provides a new and improved endless ribbon cartridge. The cartridge is capstan driven and provides for positive control of ribbon tension, both internal and external. In this regard, the invention merely requires that a capstan press the ribbon against a pair of pinch rollers, one of which is flexure mounted, as the capstan rotates. The flexure mounting is of particular significance when an inking roll is included since the flexure mounting creates constant tension across the inking roll. As the capstan is rotated, friction moves the tape into the cartridge housing. The positioning of a tension control spring, such that the tape is directly aligned with an angle slot, provides improved control over exiting tension and positioning of the tape. Further, the inclusion of an alignment roller which may or may not take the form of an inking roller, provides an uncomplicated method of aligning the tape with capstan rollers as well as a means for re-inking the tape whereby the overall useful life of the tape is greatly extended.

In its preferred form, the cartridge housing is formed of relatively high impact plastic and the spring is formed of a suitable leaf spring material. Further, the ribbon is formed of a re-inkable material.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
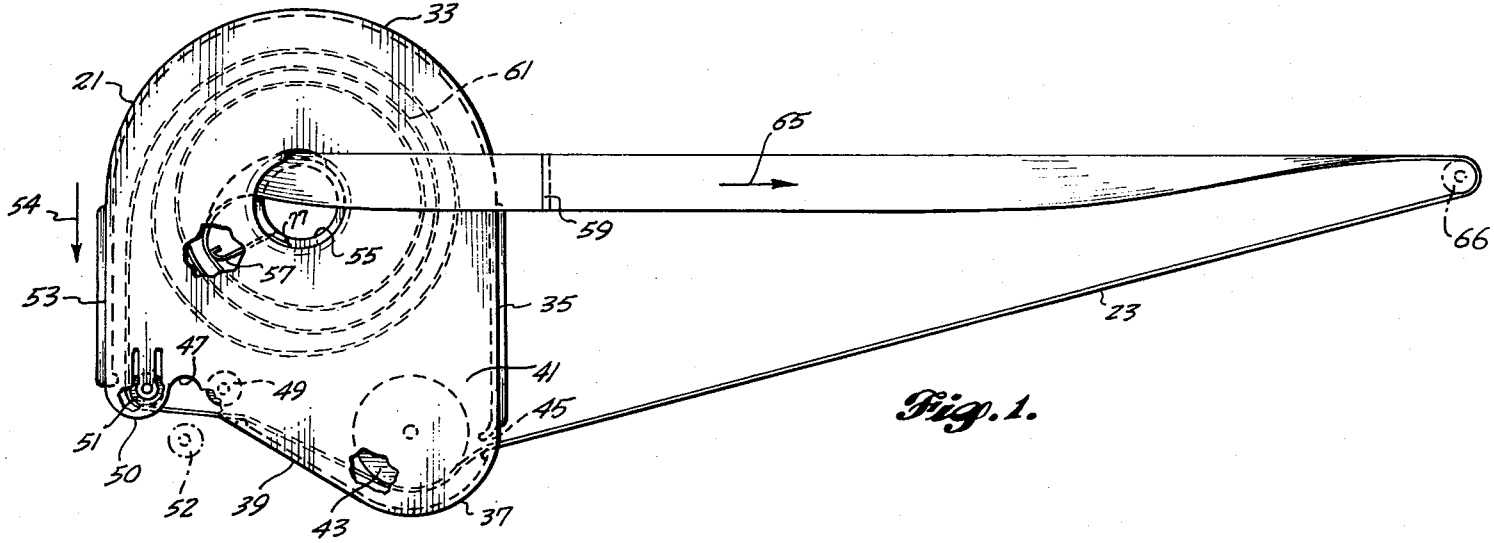
FIG. 1 is a plan view of a capstan driven, endless printer ribbon cartridge formed in accordance with the invention.
Figure 5:
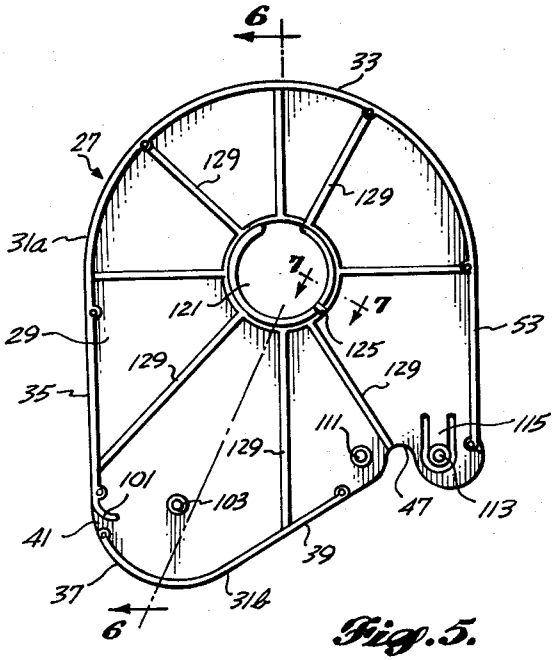
FIG. 5 is a plan view of a top suitable for use in the cartridge housing of the embodiment of the invention illustrated in FIG. 1.
Figure 6:
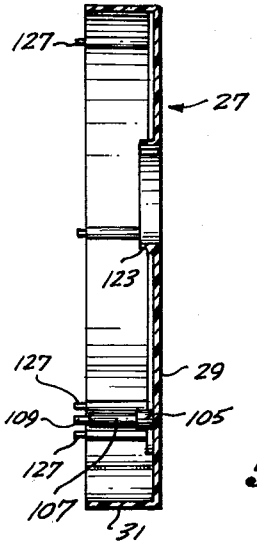
FIG. 6 is a cross-sectional view along line 6—6 of FIG. 5.

FIG. 1 is a plan view of a preferred embodiment of a capstan driven, endless printer ribbon cartridge formed in accordance with the invention and is used to illustrate and assist in describing the cartridge and its manner of operation in a general manner. The capstan driven endless printer ribbon cartridge illustrated in FIG. 1 generally comprises a cartridge housing 21 and a Mobius strip, endless printer ribbon 23. The cartridge housing 21 is generally flat or planar and comprises a base 25 (FIGS. 2 and 3) and a top 27 (FIGS. 5 and 6). The top includes a planar top wall 29 and an orthogonally outwardly projecting edge wall 31. The top wall 29 is generally configured similar to the configuration of the base 25, as more fully hereinafter described, such that when the top 27 and base 25 are suitably assembled together a relatively flat or planar cartridge housing 21 is formed.

The edge wall 29 substantially entirely surrounds the cartridge housing and forms the edge thereof. In this regard, the cartridge housing edge includes a large, semicircular edge 33 extending substantially through 180°. The large, semicircular edge 33 terminates at one end of a first planar edge 35. The first planar edge extends outwardly for a distance and terminates at one end of a curved edge 37. The curved edge 37 terminates at one end of a second planar edge 39. The first and second planar edges 35 and 39, if extended, form an acute angle with one another. The second planar edge 39 terminates at an inwardly curved indentation 47 extending through approximately 180°. The inwardly curved indentation 47 is followed by a small outwardly curved semicircular projection 50 extending through approximately 180°. The outwardly curved projection terminates at one end of a third planar edge 53. The third planar edge 53 terminates at the other end of the large semicircular edge 33.

The cartridge housing region generally defined by the first and second planar edges 35 and 39, and the curved edge 37, defines an appendage 41. Located in the appendage 41 is either a guide or an inking roller 43. Formed in the first planar edge 35 at the point where that edge meets the curved edge 37 is a ribbon inlet slot 45. The longitudinal axis of the inlet slot 45 lies orthogonal to the plane of the base and the top wall 29 and is aligned with the guide or inking roller 43 such that ribbon entering the ribbon inlet slot 45 is aligned with, freely passes around, and guided by a portion of the outer periphery of the guide or inking roll 43.

Located on either side of the inwardly curved indentation 47 are inner and outer pinch rollers 49 and 51. The inwardly curved indentation is formed such that when a capstan 52 is located therein (which occurs when the cartridge housing 21 is inserted in the direction of the arrow 54 into a suitable printing machine, such as a Series 4000 Printer produced by the Tally Corporation of Kent, Wash.), the capstan 52 is located adjacent to both of the pinch rollers 49 and 51. The positioning is such that a ribbon lying between the capstan and the pinch rollers is moved as the capstan is rotated.

In addition to the foregoing elements, the cartridge housing 21 includes a non-rotatable hub formed in the manner hereinafter described. The hub includes an aperture 55 located coaxially about the center of the axis defining of the large semicircular edge 33. Extending outwardly from the ribbon roll hub, into the interior of the housing 21 is a ribbon roll leaf spring 57.

As noted above, the printing ribbon 23 is continuous and in the form of a Mobius strip. That is, the ribbon 23 has been cut, one of the ends thereof rotated by 180°, and then the ends reattached, as illustrated by the dark line 59 in FIG. 1. The ribbon 23 enters the cartridge housing 21 via the inlet slot 45, passes around the guide roller 43 and travels to the inwardly curved indentation 47, which defines a capstan drive aperture. At the indentation 47, the ribbon 23 passes outside of the pinch rollers 49 and 51 so as to extend across or lie in the indentation. The ribbon, after passing about the outer pinch roller 51, travels to a multiple loop ribbon roll 61 located about the ribbon roll hub.

Ribbon forming the inner loop of the ribbon roll 61 passes over the outer tip of the leaf spring 57 (i.e., the tip remote from the hub and extends to an angle slot 63 (FIG. 4) more fully described hereinafter. Ribbon leaves the cartridge housing via the angle slot in the ribbon hub and passes over the top of the cartridge housing. Thus, in summary, tape enters the inlet aperture 45 passes around the guide and pinch rollers, becomes part of the ribbon roll 61 and leaves the housing via an angle slot formed in the hub. This direction of the tape movement is illustrated by the arrow 65.

The exiting ribbon passes about one or more suitably positioned idler rollers 66 (only one of which is illustrated), mounted in the printer with which the capstan driven endless printer ribbon cartridge of the invention is used. The printer idler roller or rollers, of course, define the path of travel of the ribbon 23 through the printer. The capstan, which, of course, is driven by the printer moves the ribbon through the printer since it causes ribbon to be withdrawn from the cartridge housing, as ribbon is drawn into the housing 21. Of course, each loop or layer of the ribbon roll slides on adjacent layers. This action tends to distribute ink over used portions of the ribbon. The leaf spring 57 allows the ribbon to be pulled around the hub without seizing, like a windlass, and it aligns the ribbon with the angle slot as it is withdrawn. That is, immediately after leaving the tip of the leaf spring the ribbon moves directly toward the angle slot and exits the hub.

The foregoing discussion has described the general structure and operation of the capstan driven endless printer ribbon cartridge of the invention. The following discussion will describe, in more detail, the various structural components of the cartridge housing 21, and their manner of assembly.

Figure 3:
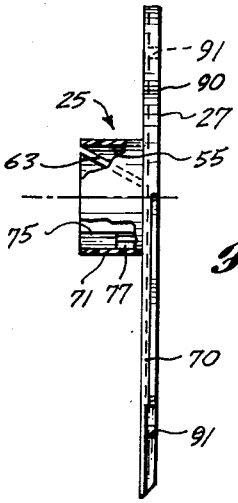
FIG. 3 is a side elevational view of the base illustrated in FIG. 2.
Figure 2:
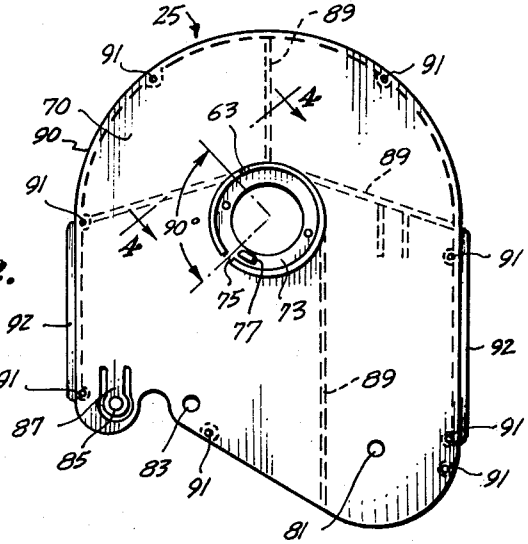
FIG. 2 is a plan view of a base suitable for use in the cartridge housing of the embodiment of the invention illustrated in FIG. 1.

FIG. 2 is a plan view of the base 25. The base 25 includes a generally base wall 70 having an outer edge configured similar to the edge configuration of the cartridge housing 21 described above with respect to FIG. 1. In addition, as best illustrated in FIG. 3, projecting outwardly from the inner face of the base wall 70 is the ribbon hub 71 discussed above as defining the hub aperture 55. Formed in the base 25, integral and planar with the planar base wall 70, in the hub aperture 55, is an inwardly projecting hub flange 73. Projecting orthogonally outwardly from the hub flange 73, inside of the hub aperture 55, is a pin-like projection 77. A spring slot 75, adapted to receive the leaf spring 57, is formed in the hub 71. The spring slot 75 lies along an axis generally parallel to the central longitudinal axis 79 of the hub 71 slightly to one side of the pin-like projection 77, in the direction of ribbon roll rotation. The pin-like projection 77 is spaced slightly inwardly from the inner surface of the hub 71. The spring slot 75 and the pin-like projection 77 are adapted to hold one end of the leaf spring 57 in a predetermined position, in the manner hereinafter described.

Figure 4:
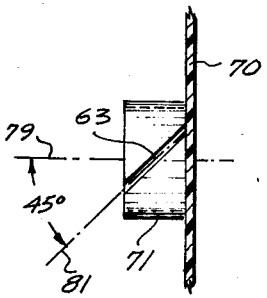
FIG. 4 is a partial side elevational view of a hub, forming a portion of the base illustrated in FIG. 2, illustrating the angle slot.

FIG. 4 illustrates in detail the angle slot 63 formed in the hub 71. Preferably, the angle slot 63 lies along an axis 81 forming an angle of 45° with respect to the central longitudinal axis 79 of the hub 71. Also, preferably, the radial center line of the slot 63 (i.e., the radial line extending outwardly from the central longitudinal axis 79 passing through the center of the slot 63) forms an angle of 90° with respect to the radial center line of the leaf slot 75, as illustrated in FIG. 2.

Formed in the base wall 70 at the center of the radius of curvature of the edge thereof bordering the curved edge 37 of the cartridge housing 21 (FIG. 1) is a first cylindrical aperture 81. The first circular aperture 81 is adapted to receive the outer or terminal end of a shaft integrally formed with the top 27 in the manner hereinafter described, and adapted to support the guide or inking roller 43.

Located on either side of the edge of the base wall 70 adjacent the inwardly curved indentation are second and third cylindrical apertures 83 and 85. The second aperture is adapted to receive the outer or terminal end of a shaft on which the inner pinch roller 49 is mounted and the third aperture 85 is adapted to receive the outer or terminal end of a shaft on which the outer pinch roller 51 is mounted. The third aperture 85 is formed in a flexure arm 87 formed in the base wall 70. The flexure arm 87 is formed by removing a U-shaped portion of the base wall 70 in the region of the wall adjacent the portion thereof defining the third aperture 85. Preferably the flexure arm is slightly thicker than the base wall. The flexure arm, in combination with a similar flexure arm formed in the top and hereinafter described provides for lateral flexure of the outer pinch roller 51. This flexure creates tension that maintains the ribbon in contact with the guide or inking roller 43. Such tension is of particular significance when this roller is an inking roller.

In addition, projecting outwardly from the outer face of the base wall 70, along selected axes, are a plurality of reinforcing ribs 89. A reinforcing rib 90 also surrounds the outer edge of the base wall 70 along the edge thereof bordering to the large, semicircular edge 33 and the first and third planar edtes 35 and 53 of the cartridge housing 21. Further edge reinforcing ribs 92 extend laterally outwardly from the edge reinforcing ribs 90 in a plane parallel to the plane of the base wall 70, in the region of the first and third planar walls 35 and 53. Also, a series of attachment apertures 91 pass through the base wall 70 adjacent to its outer periphery. The attachment apertures 91 are adapted to receive pin-shaped heads formed in the edge wall 31 of the top 27, in the manner hereinafter described.

As previously described, the top 27, which is best illustrated in FIGS. 5 and 6, includes a planar top wall 29 and an orthogonally outwardly projecting edge wall 31. The edge wall 31 includes a large section **31*a* and a small section 31*b*, as illustrated in FIG. 5. The large wall section 31*a* generally encompasses the large, semicircular edge 33 and the first and third planar walls 35 and 53. The small wall section 31*b* encompasses the second planar wall 39 and the curved edge 37. Adjacent the inlet slot 45 is an inwardly curved section 101, forming an integral extension of the large wall section 31*a***.

Located at the center of curvature of the portion of the small wall section **31*b* forming the curved edge 37 is a guide or inking roller shaft 103. As best illustrated in FIG. 6, the guide roller shaft 103 includes three co-axial aligned cylindrical regions having different diameters. The largest diameter cylindrical region 105 lies next to the top wall 29. The medium diameter cylindrical region 107 lies next to the large diameter cylindrical region and terminates at a small diameter circular region 109. The axis along which these cylindrical regions lie extends orthogonally outwardly from the top wall 29. The outer or small diameter cylindrical region forms a terminating end adapted to fit into the first cylindrical aperture 81 formed in the base wall 70. Similarly formed inner and outer roller shafts 111 and 113 extend inwardly from the top wall 29, on either side of the inwardly curved indentation 47. The terminating ends of the inner and outer shafts are adapted to fit into the second and third circular apertures 83 and 85 in the base wall. The outer roller shaft 113 is formed in a flexure arm 115 formed in the top wall 29 in the same manner as the flexure arm 87 was formed in the base wall 70, as described above with respect to FIG. 2. Preferably, all of the roller shafts 103, 111 and 113 are integrally formed with the top wall 29. The manner of mounting the various rollers on the roller shafts is hereinafter described with respect to FIG. 8**.

Figure 7:
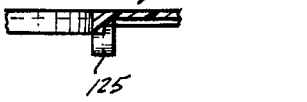
FIG. 7 is a partial cross-sectional view along line 7—7 of FIG. 5.

Formed in the top wall 29 so as to be aligned with the hub 71, when the top 27 and base 25 are assembled together, is a circular aperture 121. The circular aperture terminates in a ring-shaped inner projection 123. The inward curve is smooth and, thus, provides a low friction surface over which the ribbon 23 moves after it exits the hub via the angle slot 63. Projecting inwardly from the periphery of the ring-shaped region 123, as best illustrated in FIG. 7, is a locking pin 125. The locking pin 125 is positioned such that it is aligned with the slot 75 within which the leaf spring is held when the top 27 and base 25 are suitably aligned and locked together.

Projecting outwardly at various points in both the large and the small wall sections 31*a* and 31*b* are a plurality of pin-shaped heads 127. The pin-shaped heads 127 are positioned such that they are aligned with the peripheral apertures 91 formed in the base wall 70. When the base 25 and top 27 are suitably aligned and pressed together, the pin-shaped heads are forced into the apertures 91. The pin-shaped heads and peripheral apertures are formed such that they provide a frictional coupling mechanism. Finally, projecting radially outwardly from the ring-shaped inner projection 123 of the top wall 29 are a plurality of reinforcing ribs 129.

Figure 8:
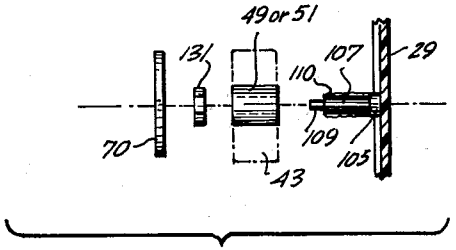
FIG. 8 is an exploded view of a pinch, guide or inking roller assembly suitable for use in the embodiment of the invention illustrated in FIG. 1.

FIG. 8 is an exploded view illustrating the mounting of either the pinch rollers or the guide (or inking) roller on their related shafts. The rollers include central cylindrical apertures adapted to fit about the medium diameter cylindrical regions 107 of their related shaft. Preferably, prior to mounting, these regions are coated with a suitable lubricant 110, such as silicone grease. Thereafter, the roller is slid onto the shaft and a locking collar 131 is added. The locking collars retain the rollers in place, and prevent significant lateral movement thereof.

Figure 9:
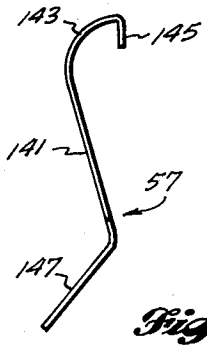
FIG. 9 is an edge view of a ribbon leaf spring suitable for use in the embodiment of the invention illustrated in FIG. 1; and, FIG. 10 is a side elevational view of the ribbon leaf spring illustrated in FIG. 9.
Figure 10:
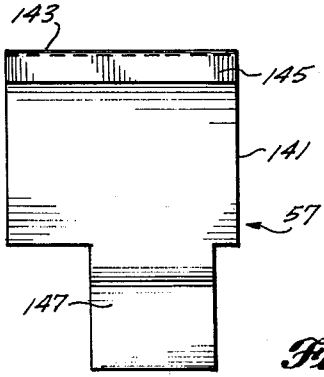

FIGS. 9 and 10 illustrate a preferred embodiment of the leaf spring 57. Preferably, the leaf spring 57, when viewed from the edge, as seen in FIG. 9, includes a main planar region 141, which terminates at one end in a curved region 143 that extends through an arc of approximately 90°. The curved region 143 terminates at an inward projection 145. Thus, a J or hook shaped end is formed in the leaf spring. The other end of the main planar region 141 terminates in an outwardly extending arm 147. The arm projects outwardly from the side of the main planar region 141 opposite to the side from which the curved region 143 extends. When viewed from the side, as seen in FIG. 10, the width of the leaf spring is substantially constant in the curved region 143, the inward projection 145 and the majority of the main planar region 141. This width is generally equal to the width of the ribbon 23. However, just prior to the point where the main planar region 141 meets the arm 147, the main planar region is necked down. The width of the arm 147 is similar to the reduced size of the necked down section of the main planar region 141.

When inserted into the spring slot 75 formed in the hub 71, the arm 147 lies between the pin-like projection 77 and the inner wall of the hub 71. The necked down section of the main planar region 141 lies in the spring slot 75, between the locking pin 125 formed in the top 27 and the bottom of the spring slot. The leaf spring is also positioned such that the J or hook shaped end points in the direction of rotation of the ribbon roll 61, as illustrated in FIG. 1.

It will be appreciated from the foregoing description that the invention comprises a capstan driven endless printer ribbon cartridge. The cartridge comprises a housing and a ribbon in the form of a Mobius strip coiled or rolled at one end. At the same time that ribbon is withdrawn into the housing, ribbon is also extended from the housing via an angle slot located in a hub. A leaf spring not only provides tension to control the removal of the ribbon, it also provides an alignment function in that it is positioned such that a space is formed between the inner loop of the ribbon roll and the hub that allows the exiting ribbon to flow directly toward the exit angle slot, as opposed to requiring that the ribbon pass further around the hub prior to exiting, as illustrated and described in U.S. Pat. No. 3,524,602, referenced above. in this regard, preferably, a layer of low friction material is affixed to the hub 71 in the region wherein the hub is impinged upon by the ribbon roll 61. Also, preferably, the majority of the elements of the cartridge housing are formed of plastic, preferably high-impact plastic. The leaf spring 57 is preferably formed of a suitable metallic material.

While a preferred embodiment of the invention has been illustrated and described, it will be appreciated that various changes can be made therein without departing from the spirit and scope of the invention. For example, the hub could be formed as an integral part of the top, as opposed to being formed as an integral part of the base, or entirely separate. Similarly the shafts could be formed as an integral part of the base, as opposed to the top, or entirely separate. Also, the tension leaf spring could be molded into the hub. Hence, the invention can be practiced otherwise than as specifically described herein.

The embodiments of the invention in which an exclusive property or privilege is claimed are defined as follows:

1. A capstan driven, endless printer ribbon cartridge comprising:

a generally flat cartridge housing suitable for housing a printer ribbon, said cartridge housing having a top wall, a base wall and an edge wall joining said top and base walls, said cartridge housing including an outwardly projecting appendage lying generally in the plane of the housing, said cartridge housing also including a ribbon inlet slot and a capstan drive aperture both located in the edge wall of said housing in the region of said appendage, said capstan drive aperture being formed in an inwardly curving indentation formed in the edge of said cartridge housing, said cartridge housing further including a central hub having a ribbon exit slot formed therein;

guide roller means mounted in said appendage for receiving printer ribbon entering said appendage via said ribbon inlet slot and directing said ribbon toward said capstan drive aperture;

pinch roller means mounted in said cartridge housing adjacent said capstan drive aperture for receiving ribbon directed by said guide roller means toward said capstan drive aperture such that when a drive capstan is positioned in said capstan drive aperture, said pinch roller means presses said ribbon against said drive capstan;

an endless printer ribbon, a first portion of said endless printer ribbon forming a ribbon roll surrounding said hub and a second portion exiting from said cartridge housing via said ribbon exit slot and entering said cartridge via said ribbon inlet slot; and, a leaf spring affixed to said hub and projecting outwardly therefrom toward said ribbon roll, said leaf spring including a hook-shaped outer end curved in the direction of said tape exit slot;

said leaf spring and said ribbon exit slot radially positioned about said hub such that said leaf spring holds said ribbon roll away from said hub in a manner such that an open space is formed between the hook-shaped end of said leaf spring and said ribbon exit slot, said ribbon passing through said space, directly from said leaf spring to said ribbon exit slot without impinging on the outer surface of said central hub after leaving said leaf spring.

2. A capstan driven, endless printer ribbon cartridge as claimed in claim 1 wherein said pinch roller means includes first and second pinch rollers located adjacent to said inwardly curving indentation, one of said pinch rollers being located on one side of said inwardly curving indentation and the other of said pinch rollers being located on the other side of said inwardly curving indentation.

3. A capstan driven, endless printer ribbon cartridge as claimed in claim 2 including flexure means for supporting one of said pinch rollers, said flexure means being formed by flexure arms formed in the top and base walls of said cartridge housing.

4. A capstan driven, endless printer ribbon cartridge as claimed in claim 3 wherein said printer ribbon is in the form of a Mobius strip.

5. A capstan driven, endless printer ribbon cartridge as claimed in claim 4 wherein said ribbon exit slot forms a predetermined angle of less than 90° with the plane of said housing.

6. A capstan driven, endless printer ribbon cartridge as claimed in claim 5 wherein said guide roller means is a guide roller.

7. A capstan driven, endless printer ribbon cartridge as claimed in claim 5 wherein said guide roller means is an inking roller.

8. A capstan driven, endless printer ribbon cartridge as claimed in claim 1 wherein said printer ribbon is in the form of a Mobius strip.

9. A capstan driven, endless printer ribbon cartridge as claimed in claim 1 wherein said guide roller means is a guide roller.

10. A capstan driven, endless printer ribbon cartridge as claimed in claim 1 wherein said guide roller means is an inking roller.

* * * * *